US010920498B1

(12) United States Patent
Bazan

(10) Patent No.: US 10,920,498 B1
(45) Date of Patent: Feb. 16, 2021

(54) DIGGING AUGER

(71) Applicant: Pedro Bazan, Mariposa, CA (US)

(72) Inventor: Pedro Bazan, Mariposa, CA (US)

( * ) Notice: Subject to any disclaimer, the term of this patent is extended or adjusted under 35 U.S.C. 154(b) by 0 days.

(21) Appl. No.: 16/401,388

(22) Filed: May 2, 2019

(51) Int. Cl.
*E21B 10/44* (2006.01)
*E21B 7/00* (2006.01)

(52) U.S. Cl.
CPC ..... *E21B 10/44* (2013.01); *E21B 7/005* (2013.01); *E21B 7/008* (2013.01)

(58) Field of Classification Search
CPC .. A01C 5/02; A01C 7/02; E21B 10/44; E21B 7/005; E21B 11/005; E21B 21/06
See application file for complete search history.

(56) References Cited

U.S. PATENT DOCUMENTS 2,709,572 A * 5/1955 Ageborn ..... F25C 5/04 175/18
4,364,441 A * 12/1982 Geeting ..... E21B 7/005 175/207
4,807,710 A * 2/1989 Greeley ..... A01C 5/02 172/111
2018/0010400 A1* 1/2018 Thomas ..... E21B 17/023

* cited by examiner

*Primary Examiner* — David Carroll
(74) *Attorney, Agent, or Firm* — Sanchelima & Associates, P.A.; Christian Sanchelima; Jesus Sanchelima

(57) ABSTRACT

The present invention is a digging auger. The digging auger comprises a shaft with a proximal end and a distal end. The digging auger also comprises a screw extending from the proximal end to the distal end of the shaft. The digging auger further comprises a paddle attachment adapted to be removably attached at the proximal end of the shaft. The paddle attachment comprises two pieces of rubber strips arranged on opposing sides of the shaft and extending generally radially outwards therefrom.

9 Claims, 2 Drawing Sheets

DIGGING AUGER

BACKGROUND OF THE INVENTION

1. Field of the Invention

The present disclosure relates generally to an auger for digging or drilling holes in the ground; and particularly relates to an auger which can prevent removed soil from the ground to fall back into the dug hole to eliminate requiring additional labor later for removal of the fallen removed soil in the dug hole.

2. Description of the Related Art

Augers are conventionally used for hole digging. An auger contains a steel shaft fitted with a peripheral spiral blade. Rotation of the auger causes the spiral blade to dig into the ground. The augers are typically manually rotated; however, powered augers rotated using a hydraulic motor that can be fitted to an excavator, a bobcat, or any other suitable powered device are also known. Often in the process of digging the hole, the loose soil is elevated and deposited on top of the ground in an area around the hole. After drilling, a portion of this soil can fall back into the hole, for example when the auger is lifted out of the hole. In such case, it may be necessary to clean out the dug holes by removing the loose dirt that has fallen back into the hole. This results in requiring additional labor in order to complete removal of the soil fallen back into the hole.

Typically for smaller holes, the removal of fallen back soil is done by hand or using a small hand scoop, and the like. For larger and deeper holes, typically a shovel or some other tools are used. It is also known to provide a special hole cleaning device which comprises a pair of long arm scoops. However, this tool is difficult to use and is not extremely efficient in scooping out loose dirt from a hole. Furthermore, such devices have usually been relatively cumbersome and require attachment to the auger. In any case, in all such cases, additional labor is still required for cleaning of soil that has fallen back into the dug holes.

Applicant believes that a related application corresponds to U.S. Pat. No. 4,807,710 issued to Greeley discloses an earth auger for planting bulbs. The earth auger is provided with a clearing blade near the top of the flight for clearing loose soil from about the mouth of the drilled hole. A second blade is provided at the distal end of the auger within the contour of the flight for cutting of fibrous roots and to loosen the soil to encourage plant root growth. Herein, the design of clearing blade is not suitable to remove all of close soil that have been dug out from the ground, and thus there is a risk that the loose soil may fall back into the dug hole, thus requiring additional labor to remove the same.

Other documents describing the closest subject matter provide for a number of more or less complicated features that fail to solve the problems described above in an efficient and economical way. None of the documents suggest the novel features of the present invention.

SUMMARY OF THE INVENTION

It is one of the main objectives of the present invention to provide a digging auger with a paddle attachment for clearing loose soil as removed from digging of a hole in the ground.

It is another objective of the present invention to provide a digging auger which is simple to operate.

It is yet another objective of the present invention to provide a digging auger of simple construction and which is inexpensive to manufacture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
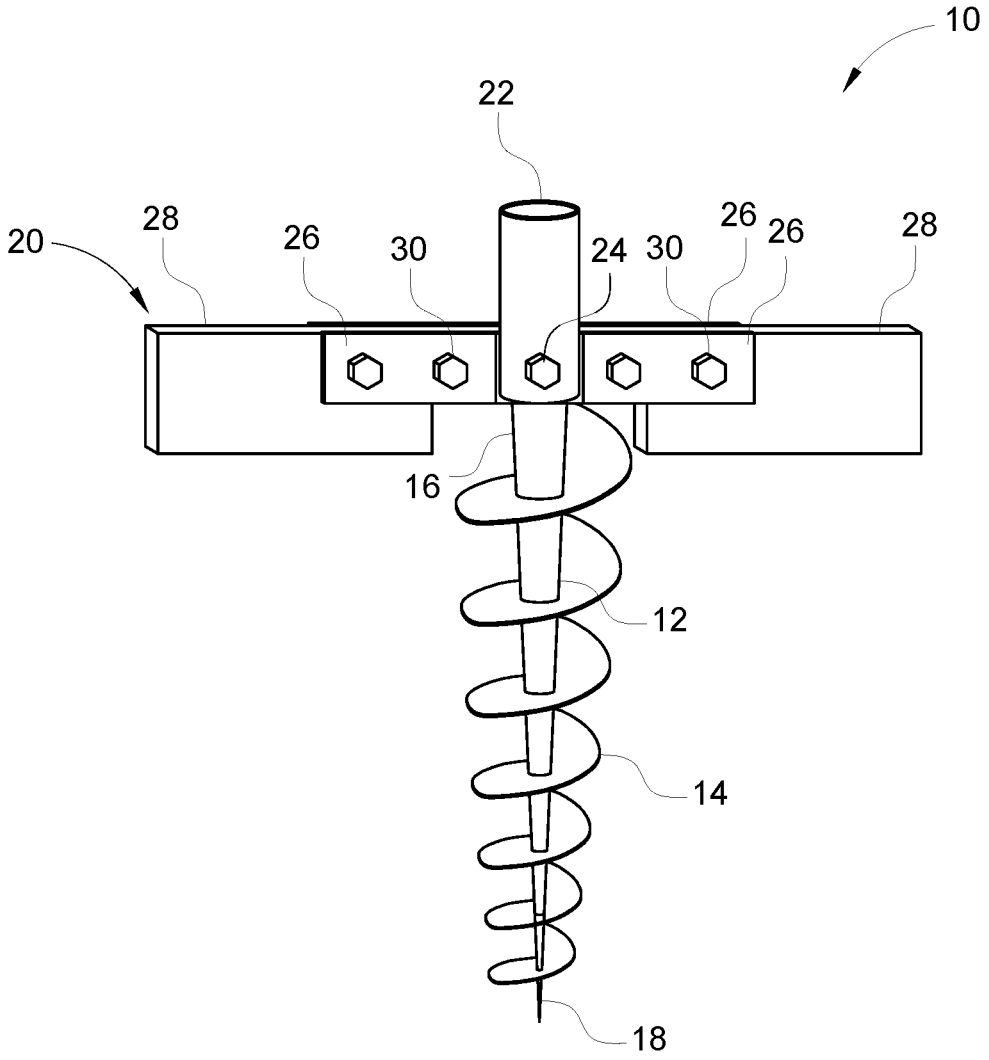
FIG. 1 illustrates an isometric view of a digging auger 10.

Referring to the drawings, FIG. 1 illustrates an isometric view of a digging auger, generally designated by the numeral 10, in accordance with embodiments of the present disclosure. As illustrated, digging auger 10 comprises a shaft 12 and a screw 14 which extends about shaft 12 from a proximal end 16 to a distal end 18 thereof, for forming a hole in the ground. Shaft 12 may be a steel shaft fitted with a peripheral spiral blade acting as screw 14. Such construction of augers is well known in the art and there exists many variations related to size, shape and configurations of shaft and screw as known in the art for various specific purposes, all of which are incorporated herein without any limitations.

Shaft 12 of digging auger 10 can be of a relatively small size so to fit into a power drill or the like as well as to reduce overall bulk and weight of digging auger 10. For example, shaft 12 can be made with a diameter of about 0.5 inch to 2 inches. Further, shaft 12 is made of a suitable length so as to permit a user to drill a multiplicity of holes in the ground from a comfortable position. For example, shaft 12 may be of a length of about 20 inches to 40 inches. Further, digging auger 10 is constructed so that screw 14 has an outside diameter which is suitable for drilling holes of a size depending on the required application. For example, screw 14 can be made with an outside diameter from about 1 inch to about 10 inches.

Digging auger 10 digs into the ground to a desired depth. Rotation of digging auger 10 causes screw 14 to dig into the ground. Digging auger 10 is typically rotated using a hydraulic motor that can be fitted to an excavator, a bobcat, or any other suitable powered device. For instance, digging auger 10 may be coupled to a hydraulic motor, and the hydraulic motor may be coupled to the front lifting arms of a bobcat. It is however envisaged that in some examples, digging auger 10 can be manually rotated without departing from the scope of the present disclosure. When digging auger 10 has dug into the ground to a desired depth, the entire digging auger 10 is lifted out of the ground to form the desired hole. This is achieved by raising the entire digging auger 10 manually or by using a hydraulic rain, and the like.

According to embodiments of the present disclosure, digging auger 10 is provided with a paddle attachment 20. As illustrated, paddle attachment 20 is generally coupled to shaft 12 of digging auger 10 at proximal end 16 thereof. Paddle attachment 20 extends radially outwards from shaft 12 at a predetermined distance from proximal end 16. As will be discussed later in more detail, paddle attachment 20 extends radially outwardly for clearing soil from about the mouth of a hole as drilled in the ground by screw 14 in digging auger 10.

Figure 2:
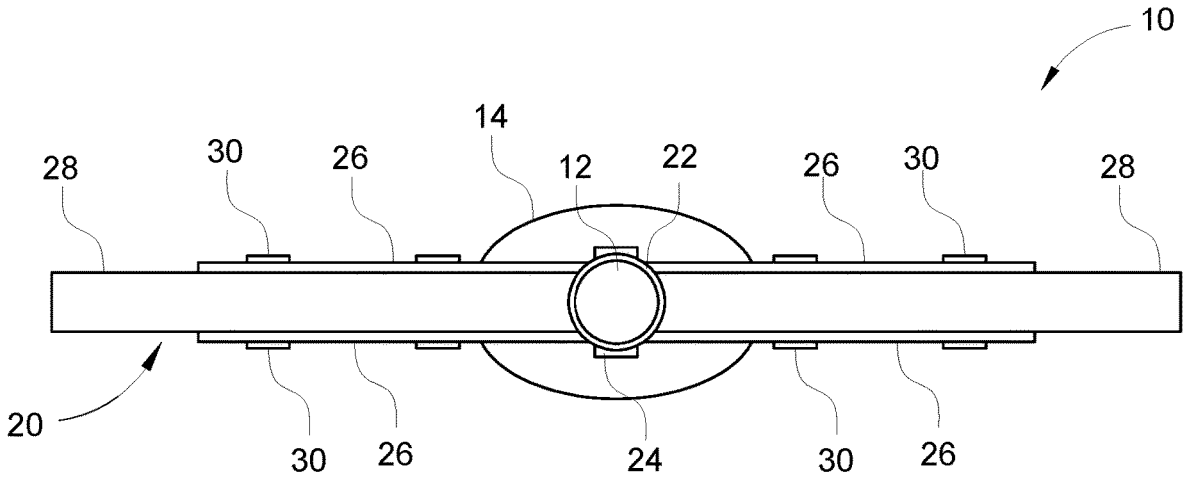
FIG. 2 illustrates a top view of the digging auger 10.

Referring to FIGS. 1-2 in combination, paddle attachment 20 includes a collar 22 which is adapted to be mounted onto shaft 12 of digging auger 10. This way paddle attachment 20 is removably attached or mounted to digging auger 10. It may be appreciated that collar 22 can be a hollow cylindrical member with inner diameter substantially equal to outer diameter of shaft 12, so as to allow mounting of collar 22 to shaft 12. Collar 22 may be made of similar material as that of shaft 12, such as metal like steel or the like. It may be understood that collar 22 and shaft 12 have a good interference fit so as to ensure proper mounting of paddle attachment 20 to digging auger 10. In one or more embodiments, paddle attachment 20 also includes a cotter pin 24 which may be inserted through collar 22 and further through a hole in shaft 12, to ensure proper engagement of collar 22 to shaft 12, without risk of paddle attachment 20 coining loose from digging auger 10 during operation. Further, such cotter pin 24 may allow easy mounting and removal of paddle attachment 20 from digging auger 10, as may be required for different work operations.

Further, as illustrated, paddle attachment 20 includes four pieces of metal strips 26. The four pieces of metal strips 26 are welded to collar 22 and are arranged such that two pairs of two metal strips 26, out of the four pieces of metal strips 26, are disposed along two opposing lateral or diametrically opposite sides of collar 22. Such pair of metal strips 26 arranged at each side of collar 22 are disposed or relatively positioned in a manner to have gaps therebetween. Also, as illustrated, paddle attachment 20 includes two pieces of rubber strips 28 which may extend along radial length of paddle attachment 20. Two pieces of rubber strips 28 are placed at two sides of collar 22, in gaps between each pair of two metal strips 26 arranged at each side of collar 22. As may be seen, each of two pieces of rubber strips 28 is larger in length as compared to any of metal strips 26, and is extending along an entire radial length of paddle attachment 20, even more so than radial length of screw 14 in digging auger 10. Furthermore, as illustrated, paddle attachment 20 includes button bolts 30, with two number of button bolts 30 provided on each of two pairs of metal strips 26. The button bolts 30 extend through both metal strips 26 of each of two pairs of metal strips 26, passing through corresponding rubber strips 28 located therebetween, and thereby fixedly attach rubber strips 28 to corresponding pair of metal strips 26, and thus making paddle attachment 20 an integrated assembly which can be removably attached to digging auger 10, as required.

When digging auger 10 is being implemented for drilling of a hole in the ground, paddle attachment 20 clears the soil which is lifted by screw 14 during drilling from about the mouth of the hole, after the hole has been drilled to the predetermined or desired depth. To this end, paddle attachment 20 is, sometimes, shaped or arranged, to provide an angularly disposed edge which extends beyond screw 14 for clearing of the mound of soil from about a drilled hole. Thus, use of paddle attachment 20 with digging auger 10 results in convenience, labor and time saving for users, as need of additional labor for removal of excess soil as dug from ground with risk of being fallen back therein is eliminated. Digging auger 10 and the associated paddle attachment 20 is of relatively simple construction and can be made in any suitable manner. For example, paddle attachment 20 for clearing the soil can be welded to shaft 12 or otherwise connected. Likewise, screw 14 can be fixed to shaft 12 in any suitable manner.

In some examples, digging auger 10 may also include a means on distal end 18 of shaft 12 having a cutting edge for cutting small roots such as fibrous roots, for example when digging for holes for plantation purposes. For example, the means may be in the form of a blade of triangular shape which extends radially of shaft 12 and radially within the length of paddle attachment 20. Such additional blade may also serve to cut small fibrous roots in the ground which may impede drilling of a hole by digging auger 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense in any manner.

What is claimed is:

1. A digging auger, comprising:

a shaft with a proximal end and a distal end;

a screw extending from said proximal end to said distal end of said shaft; and a paddle attachment adapted to be removably attached at said proximal end of said shaft, said paddle attachment comprises two pieces of rubber strips arranged on opposing sides of said shaft and extending generally radially outwards therefrom, wherein said paddle attachment further comprises a collar adapted to be mounted onto said shaft to allow for removable attachment of said paddle attachment with said digging auger, wherein said paddle attachment further comprises four pieces of metal strips welded to said collar and are arranged such that two pairs of two said metal strips are disposed along two opposing sides of said collar with gaps therebetween.

2. The digging auger of claim 1, wherein said paddle attachment further comprises a cotter pin inserted through said collar and said shaft to ensure proper engagement therebetween.

3. A digging auger, comprising:

a shaft with a proximal end and a distal end;

a screw extending from said proximal end to said distal end of said shaft; and a paddle attachment adapted to be removably attached at said proximal end of said shaft, said paddle attachment comprising a collar adapted to be mounted onto said shaft to allow for removable attachment of said paddle attachment with said digging auger, four pieces of metal strips welded to said collar and are arranged such that two pairs of two said metal strips are disposed along two opposing sides of said collar with gaps therebetween and two pieces of rubber strips placed at opposing sides of said collar in gaps between each pair of two said metal strips.

4. The digging auger of claim 3 further comprising button bolts provided on each of two pairs of said metal strips to fixedly attach said rubber strips therewith.

5. The digging auger of claim 1 wherein said shaft tapers from said proximal end to said distal end.

6. The digging augur of claim 1 wherein said screw tapers from said proximal end to said distal end.

7. The digging auger of claim 1 wherein said collar has a cylindrical shape.

8. The digging auger of claim 2 wherein said cotter pin is a hexagonal cotter pin.

9. The digging auger of claim 1 wherein said four pieces of metal strips are rectangular in shape.

* * * * *